US009320956B2

(12) United States Patent
DeMarco

(10) Patent No.: US 9,320,956 B2
(45) Date of Patent: Apr. 26, 2016

(54) TRAINING AID AND TRAINING METHOD

(71) Applicant: Samuel DeMarco, Hollywood, FL (US)

(72) Inventor: Samuel DeMarco, Hollywood, FL (US)

( * ) Notice: Subject to any disclaimer, the term of this patent is extended or adjusted under 35 U.S.C. 154(b) by 0 days.

(21) Appl. No.: 14/272,609

(22) Filed: May 8, 2014

(65) Prior Publication Data

US 2015/0321065 A1 Nov. 12, 2015

(51) Int. Cl.

| | |
|---|---|
| ***A63B 57/00*** | (2015.01) |
| ***A63B 69/36*** | (2006.01) |
| ***A63B 63/00*** | (2006.01) |
| ***A63B 63/08*** | (2006.01) |

(52) U.S. Cl.

CPC ..... *A63B 69/36* (2013.01); *A63B 63/00* (2013.01); *A63B 63/08* (2013.01); *A63B 2208/0204* (2013.01)

(58) Field of Classification Search

CPC ..... A63B 63/00; A63B 69/36; A63B 71/023; F41J 1/10

USPC ..... 473/172, 195–197, 439, 454–456, 462; 273/348–410; 482/16–17

See application file for complete search history.

(56) References Cited

U.S. PATENT DOCUMENTS

| | | | | |
|---|---|---|---|---|
| 3,836,144 | A * | 9/1974 | Mahoney | 473/435 |
| 4,993,719 | A * | 2/1991 | Hernandez | 473/492 |
| 5,330,199 | A * | 7/1994 | Vand | 273/400 |
| 5,570,889 | A * | 11/1996 | Tyrer | 273/348.4 |
| 5,611,539 | A | 3/1997 | Watterson et al. | |
| 7,549,950 | B1 * | 6/2009 | Lundquist et al. | 482/101 |
| 8,021,241 | B2 | 9/2011 | Graga et al. | |
| 8,409,024 | B2 | 4/2013 | Marty et al. | |
| 2004/0147331 | A1 * | 7/2004 | Feller | 473/173 |
| 2005/0098770 | A1 | 5/2005 | Schell | |
| 2005/0192126 | A1 * | 9/2005 | Remaklus | 473/447 |
| 2012/0040769 | A1 * | 2/2012 | Swingle et al. | 473/195 |

FOREIGN PATENT DOCUMENTS

| | | | |
|---|---|---|---|
| WO | 91/08805 | A1 | 6/1991 |

* cited by examiner

*Primary Examiner* — Melba Bumgarner
*Assistant Examiner* — Laura L Davison
(74) *Attorney, Agent, or Firm* — Spilman, Thomas & Battle PLLC; William P. Smith

(57) ABSTRACT

A golf training aid and golf training method are provided. The golf training aid includes a body portion, including a support, a first housing, and a second housing, a base portion, and an elevated target. The golf training method includes providing a golf training aid including a body portion including a first housing and a second housing, a base portion, and an elevated target, positioning a rocker arm between extendable sections of two upright posts attached to the first housing and two upright posts attached to the second housing, sliding and rotating the rocker arm positioned between the extendable sections to provide a rocker arm orientation, positioning caps over the two upright posts attached to the first housing and the two upright posts attached to the second housing, attaching the elevated target to the rocker arm, and hitting golf balls at the elevated target.

16 Claims, 6 Drawing Sheets

TRAINING AID AND TRAINING METHOD

FIELD OF THE INVENTION

The present invention is directed to a training aid and training method. More specifically, the present invention is directed to an adjustable golf training aid and a golf training method.

BACKGROUND OF THE INVENTION

Golf is a popular recreational sport involving varying levels of difficulty. During a round of golf players may encounter many different obstacles that require player adjustments and precise placement of shots. In order to prepare for the different obstacles, golfers of all skill levels often require practice.

Many different training devices focus on driving, putting, and/or the mechanics of a golf swing. However, in addition to the distance and direction of the ball, golfers must also control the loft. Although different club angles provide different lofts, providing the right combination of distance and loft to avoid the many different obstacles may require adjustments by the golfer.

One currently available device includes targets placed on the ground. The targets are often bulky, lack adjustability, are unable to simulate obstacles, and fail to provide a loft obstacle. Another device includes targets hung on a wall for use with a Nerf ball or whiffle golf ball. The targets require a wall, do not reflect the power of a shot, and are not compatible with real golf balls.

A training aid with improvements in the device and/or the training process would be desirable in the art.

BRIEF DESCRIPTION OF THE INVENTION

In one embodiment, a golf training aid includes a body portion, including a support, a first housing, and a second housing, a base portion, and an elevated target.

In another embodiment, a golf training method includes providing a golf training aid including a body portion including a first housing having two upright posts attached thereto, and a second housing having two upright posts attached thereto, a base portion, and an elevated target, supporting the body portion with the base portion, positioning a rocker arm between extendable sections of the two upright posts attached to the first housing and the two upright posts attached to the second housing, sliding and rotating the rocker arm positioned between the extendable sections to provide a rocker arm orientation, positioning caps over the two upright posts attached to the first housing and the two upright posts attached to the second housing, attaching the elevated target to the rocker arm, and hitting golf balls at the elevated target.

In another embodiment, a golf training method includes providing a golf training aid including, a body portion including a first housing having two upright posts attached thereto, and a second housing having two upright posts attached thereto, a base portion, and a retractable net extending between the first housing and the second housing, securing the base portion to a surface, separating the first housing and the second housing to expose a portion of the retractable net extending therebetween, supporting the first housing and the second housing with the base portion to maintain the exposed portion of the retractable net, and hitting golf balls over or under the retractable net. The base portion includes two stakes for separately supporting the first housing and the second housing.

Certain advantages of the embodiments described herein include providing a structure for golf training, chipping, and/or skill games.

Another advantage includes providing a golf training aid having an adjustable height and width.

Further advantages include increased portability, and a plurality of interchangeable targets.

BRIEF DESCRIPTION OF THE DRAWINGS

Wherever possible, the same reference numbers will be used throughout the drawings to represent the same parts.

DETAILED DESCRIPTION OF THE INVENTION

Figure 2:
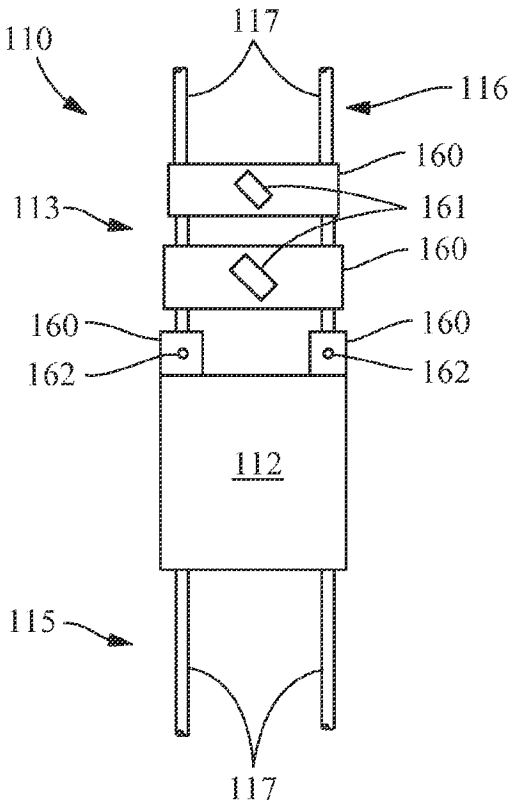
FIG. 2 is a side view of a body portion of the training aid of FIG. 1.

Referring to FIGS. 1-6, in one embodiment, a golf training aid 100 includes a body portion 110 having and/or providing support for an upright or elevated target 111. In another embodiment, the golf training aid 100 includes a base portion 130, such as, but not limited to, a tripod 132, a stake 154 (FIG. 8), or a combination thereof. The body portion 110 may be positioned directly on a surface, or supported by the base portion 130 positioned on the surface. In the embodiments shown in FIGS. 1, 3, and 5, the base portion 130 includes a tripod 132. The tripod 132 has an adjustable post 132*a* to vary a height 135 of the body portion 110, for example, between about 1 foot and about 6 feet.

Figure 1:
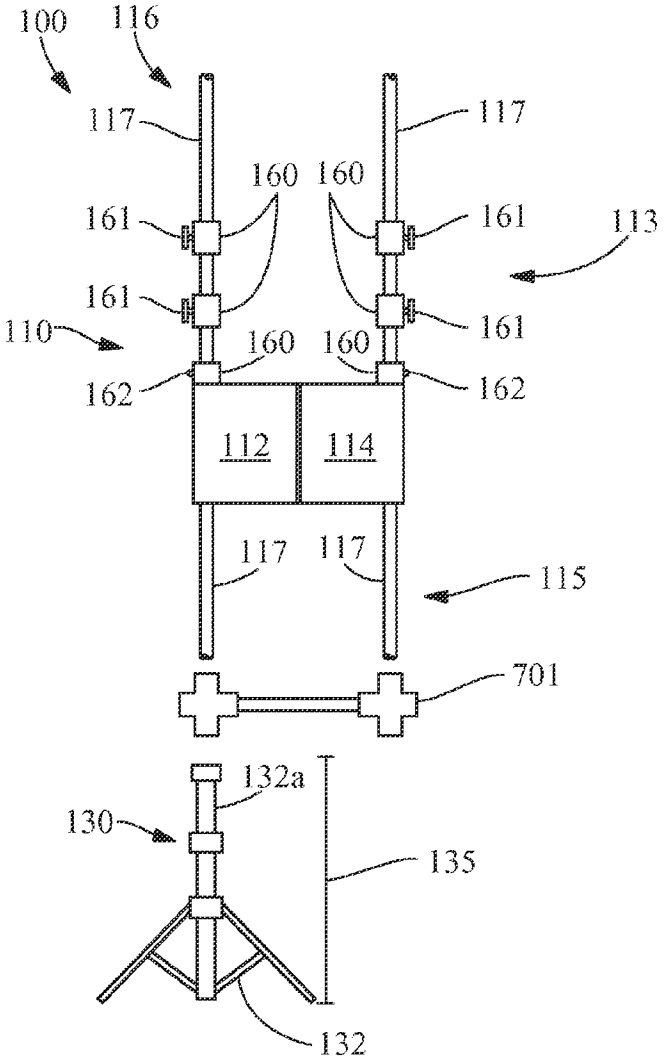
FIG. 1 is an exploded view of a training aid, according to an embodiment of the disclosure.
Figure 4:
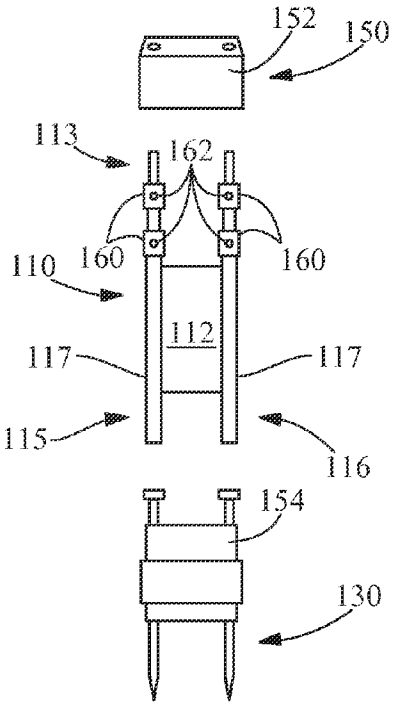
FIG. 4 is an exploded side view of the training aid of FIG. 3, without the rocker arm.

Referring to FIGS. 1-2, the body portion 110 includes a support 116, a first housing 112 and a second housing 114. In the exemplary embodiment the support 116 includes two upright posts 117 for supporting the first housing 112 and the second housing 114. In an alternate embodiment additional upright posts 117 may be provided in support 116. The upright posts 117 may include tubes, pipes, rods, doweling, any other suitable member for supporting the first housing 112 and/or the second housing 114, or a combination thereof. For example, in one embodiment, the support 116 includes two hollow tubes secured to the first housing 112, and two hollow tubes secured to the second housing 114. In another embodiment, the upright posts 117 either extend through (FIG. 2) or are attached to (FIG. 4) the first housing 112 and/or the second housing 114. In a further embodiment, each of the upright posts 117 includes an extendable section 113 and a fixed section 115. The extendable section 113 of each of the upright posts 117 includes a telescoping portion, a collapsing portion, any other extendable or retractable portion, or a combination thereof.

The extendable section 113 is maintained in the extended or refracted position by locking members 160. Locking members may include clamps, pins, screws, detents, or any other locking member capable of maintaining a position of the upright posts 117 in the extendable section 113. For example, in the embodiment shown in FIGS. 1-2, the locking members 160 include a threaded member 161 for tightening and loosening the locking member 160. In another example, as shown in FIGS. 1-6, the locking members 160 may include a detent 162 for maintaining the position of the upright posts 117.

In one embodiment, a retaining member 701 is positioned over the fixed section 115 of at least one of the upright posts 117 of the first housing 112 and one of the upright posts 117 of the second housing 114 to reduce or eliminate a separation of the first housing 112 from the second housing 114. The retaining member 701 corresponds to a length between the upright posts 117 of the first housing 112 and the upright posts 117 of the second housing 114. In one example, a first aperture in the retaining member 701 receives the fixed section 115 of one of the upright posts 117 extending from the first housing 112, and a second aperture in the retaining member 701 receives the fixed section 115 of one of the upright posts 117 extending from the second housing 114. When positioned over the upright posts 117 the retaining member 701 maintains the position of the first housing 112 relative to the second housing 114.

Figure 3:
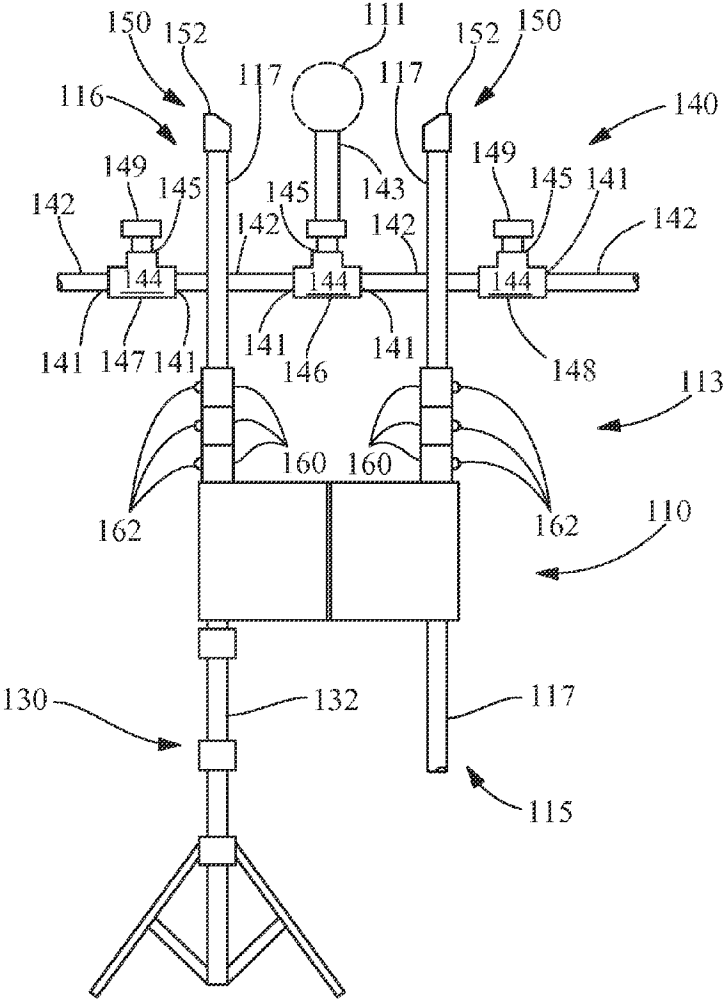
FIG. 3 is a front view of a training aid including a rocker arm, according to an embodiment of the disclosure.
Figure 5:
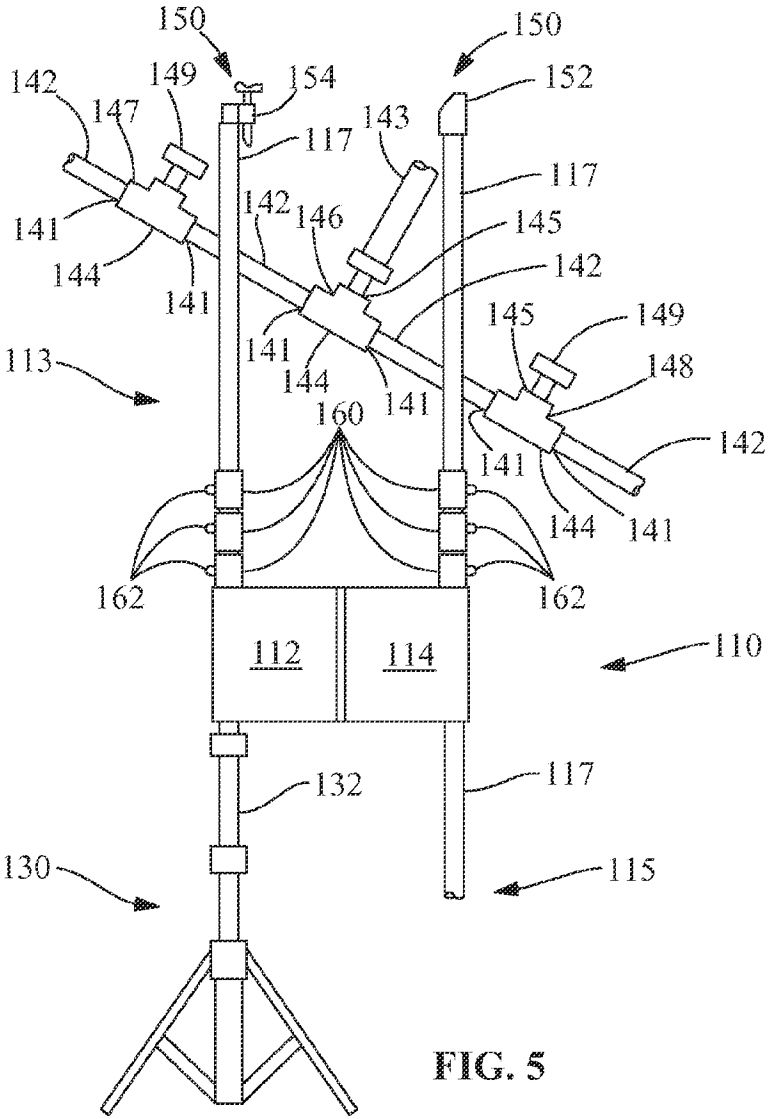
FIG. 5 is a front view of a training aid including an angled rocker arm, according to an embodiment of the disclosure.

Referring to FIGS. 3 and 5, in one embodiment, the fixed section 115 of at least one of the upright posts 117 extending from the first housing 112 or the second housing 114 is secured to the base portion 130. Securing the fixed section 115 to the base portion 130 includes, for example, inserting the fixed section 115 into the tripod 132. The fixed section 115 secured to the base portion 130 provides support for the body portion 110.

In one embodiment, when the fixed section 115 is secured to the base portion 130, the target 111 is attached to the extendable section 113 and/or a rocker arm 140 supported by the extendable section 113. Suitable targets for chipping golf balls at or into include, but are not limited to, an umbrella, a net, a soft object, scoring rings, or similar targets. The target 111 may be detachable, adjustable, and/or interchangeable. In one embodiment, the target 111 may be adjusted by extending or retracting the adjustable post 132*a*, the extendable section 113, and/or an orientation of the rocker arm 140. After the target 111 is positioned, the golf training aid 100 provides a vertical and horizontal challenge for a user to practice hitting golf balls at. For example, the user may chip at the target 111 for practice, as a skill game with others, or for fun.

Figure 6:
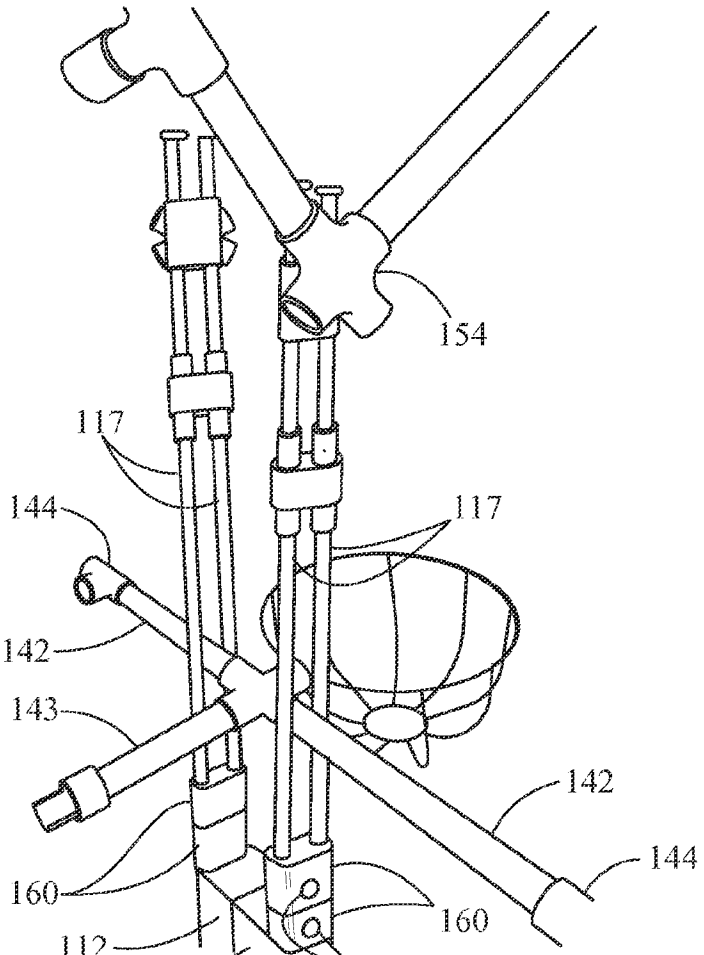
FIG. 6 is a perspective view of a training aid including a rocker arm and attachments, according to an embodiment of the disclosure.

Referring to FIGS. 3 and 5-6, the rocker arm 140 includes lateral portions 142, at least one intersecting portion 143, and tee fittings 144. The lateral portions 142 may be hollow tubes, pipes, cylinders, or similar structural material. In one embodiment, the tee fittings 144 have openings 141 for receiving the lateral portions 142, and one intersecting opening 145. In another embodiment, the rocker arm 140 includes three tee fittings 144, for example, the middle connector 146, the first end connector 147, and the second end connector 148. The intersecting opening 145 of each of the tee fittings 144 provides an attachment point for the intersecting portion 143 or a plug 149. In a further embodiment, the rocker arm 140 includes angled fittings for connecting the lateral portions 142 and/or the targets 111 to the rocker arm 140 at an angle.

Figure 12:
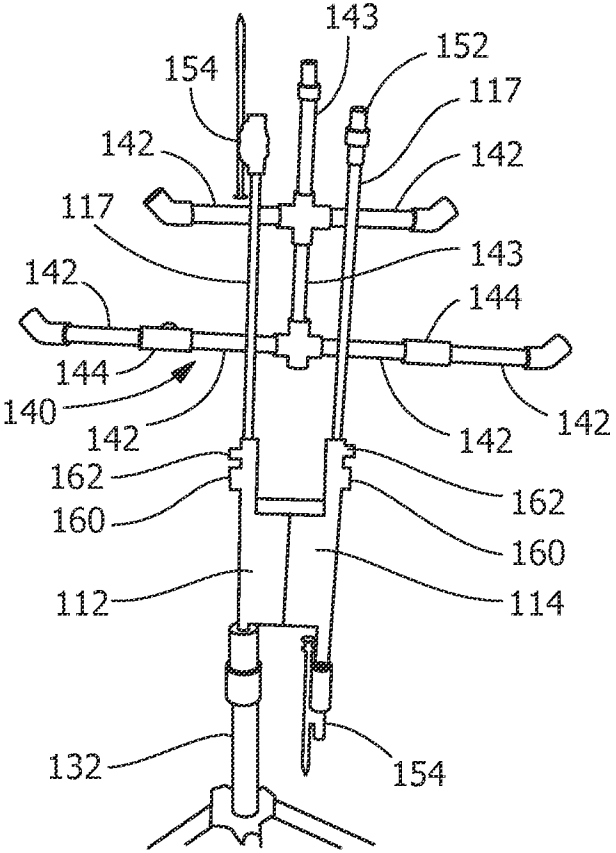
FIG. 12 is a front view of a training aid including a multi-level rocker arm, according to an embodiment of the disclosure.

Referring to FIG. 12, in another embodiment, the rocker arm 140 includes two or more sections attached to one of the intersecting portions 143, each section including at least one of the lateral portions 142. For example, in one embodiment, the rocker arm 140 includes a first section and a second section, each section having at least one cross fitting. The cross fitting of each section is secured to an opposite end of one of the intersecting portions 143 to couple the first section to the second section. Extending from the cross fitting of each section is at least one lateral portion 142 with the tee fitting 144, the angled fitting, and/or the target 111 secured thereto. The rocker arm 140 may also include additional intersecting portions 143 extending from the cross fitting and/or the tee fitting 144 of the first section and/or the second section.

As shown in FIGS. 3, 5, 6, and 12, to support the rocker arm 140, the lateral portions 142 of the rocker arm 140 are positioned between the extendable sections 113 of the upright posts 117 of the first housing 112 and the second housing 114. For example, in one embodiment, a section of the lateral portions 142 extending from a first end connector 147 to a middle connector 146 is positioned between the two upright posts 117 of the first housing 112, and a section of the lateral portions 142 extending from the middle connector 146 to the second end connector 148 is positioned between the two upright posts 117 of the second housing 114. An outer diameter of the lateral portions 142 permits sliding and/or rotating of the lateral portions 142 positioned between the two upright posts 117, while a larger outer diameter of the tee fittings 144 reduces or eliminates a sliding of the tee fittings 144 through the two upright posts 117.

In one embodiment, the intersecting portion 143 is attached to one of the tee fittings 144, for example, the tee fitting 144 forming the middle connector 146. In another embodiment, more than one of the intersecting portions 143 is attached to a corresponding number of tee fittings 144. For example, two of the intersecting portions 143 attached to the intersecting openings 145 on two of the tee fittings 144. One or more of the intersecting portions 143 includes the target 111 integrally or detachably secured thereto.

After positioning the rocker arm 140 between the two upright posts 117 of the first housing 112 and the second housing 114, the sliding and/or rotating of the lateral portions 142 provides any suitable orientation of the rocker arm 140. For example, as shown in FIG. 3, the lateral portions 142 are oriented perpendicular, or substantially perpendicular, to the two expandable tubes 116 (e.g., an x-direction), with the intersecting portion 143 parallel, or substantially parallel, with the two expandable tubes 116 (e.g., a y-direction). In another example, as shown in FIG. 5, the lateral portions 142 are oriented at an angle to the two expandable tubes 116, such as, but not limited to, about 45°. In one embodiment, the plug 149 in the opening 145 of either the first end connector 147 or the second end connector 148 provides a stop for the angle of the rocker arm 140. In another embodiment, as shown in FIG. 6, the rotating of the lateral portions 142 between the two expandable tubes 116 rotates the intersecting portions 143 to provide any suitable rotational position of the intersecting portions 143 (e.g., a z-direction).

In one embodiment, at least one of the tee fittings 144 is rotatable independent of the lateral portions 142 and/or the other tee fittings 144 to provide variable rotational positions for each of the intersecting openings 145. For example, in another embodiment, the intersecting openings 145 of the three tee fittings 144 are aligned or substantially aligned with each other. In another example, the intersecting openings 145 of the first end connector 147 and the middle connector 146 are aligned, and the intersecting opening 145 of the second end connector 148 is rotated 90° as compared to the other intersecting openings 145.

Figure 7B:
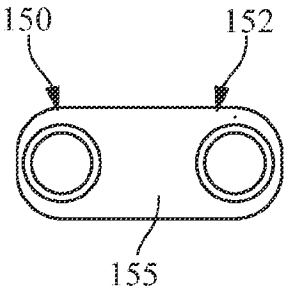
FIG. 7B is a bottom view of an end cap, according to an embodiment of the disclosure.
Figure 7A:
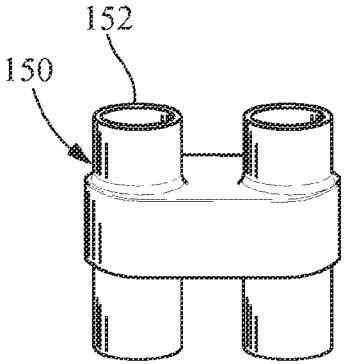
FIG. 7A is a front view of an end cap, according to an embodiment of the disclosure.

Once the rocker arm 140 has been oriented, through sliding and/or rotating the lateral portions 142, a cap 150 is positioned over the upright posts 117 of each of the first housing 112 and the second housing 114. The cap 150 may include an end cap 152 (FIGS. 7A, 7B), the stake 154 (FIG. 8A, 8B, 8C), any other article for being positioned on the upright posts 117 of the first housing 112 or the second housing 114, or a combination thereof. In one embodiment, the stake 154 is inserted within the two upright posts 117 of the first housing 112 and/or the second housing 114 to apply a pressure to the upright posts 117. The pressure applied to the upright posts 117 urges the upright posts 117 towards each other, which applies pressure to the lateral portions 142 positioned between the upright posts 117. The pressure applied to the lateral portions 142 maintains the orientation of the rocker arm 140 relative to the body portion 110.

As shown in FIGS. 7A-8C, the cap 150 includes a receiving portion 155. Referring to FIGS. 7A-8B, in one embodiment, the receiving portion 155 is configured to receive the upright posts 117 of the first housing 112 and/or the second housing 114. Inserting the upright posts 117 within the receiving portion 155 applies pressure to the lateral portions 142 to maintain the orientation of the rocker arm 140. In another embodiment, the receiving portion 155 receives both the upright posts 117 and additional articles such as the stake 154, the target 111, and/or a target support. Referring to FIG. 6, for example, the end cap 152 includes parallel apertures extending therethrough for receiving the upright posts 117 in a first side and the stake 154 in a second side opposite the first side. In a further embodiment, the cap 150 may include apertures having a parallel section for receiving the upright posts 117 and an intersecting portion for receiving the additional articles. For example, the apertures may form a "Y" shape, a "T" shape, or any other shape for receiving the additional articles at an angle to the upright posts 117.

Figure 8C:
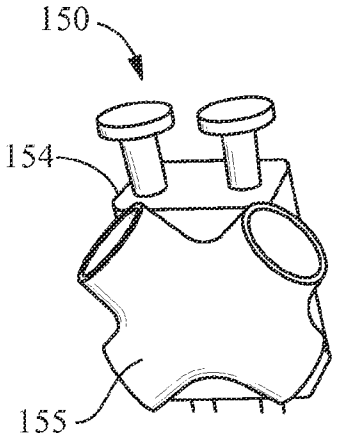
FIG. 8C is a perspective view of a stake, according to an embodiment of the disclosure.
Figure 8B:
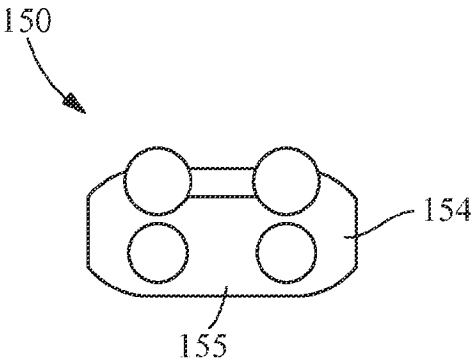
FIG. 8B is a top view of a stake, according to an embodiment of the disclosure.
Figure 8A:
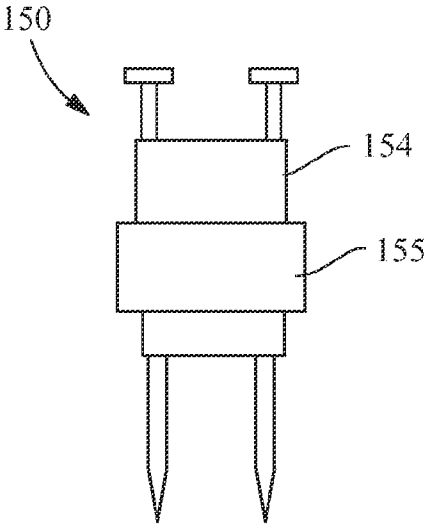
FIG. 8A is a front view of a stake, according to an embodiment of the disclosure.

Alternatively, as shown in FIGS. 6 and 8C, the receiving portion 155 of the stake 154 is configured to receive the additional articles separate from the upright posts 117. For example, the stake 154 may be inserted within the two upright posts 117 or the end cap 152 to provide the receiving portion 155 separate from the upright posts 117. The receiving portion 155 configured to receive the additional articles separate from the upright posts 117 includes apertures having any orientation for securing the target 111 thereto. Aperture orientations include, for example, perpendicular, parallel, and/or angled with respect to the upright posts 117. For example, the receiving portion 155 may include intersecting apertures forming an "X" on the stake 154.

Figure 10:
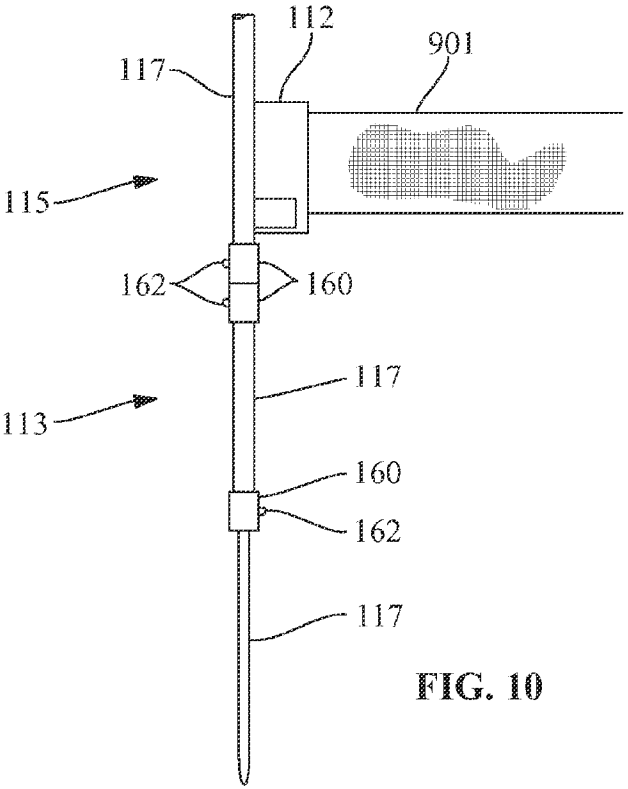
FIG. 10 is a section view of an expanded training aid, according to an embodiment of the disclosure.
Figure 9:
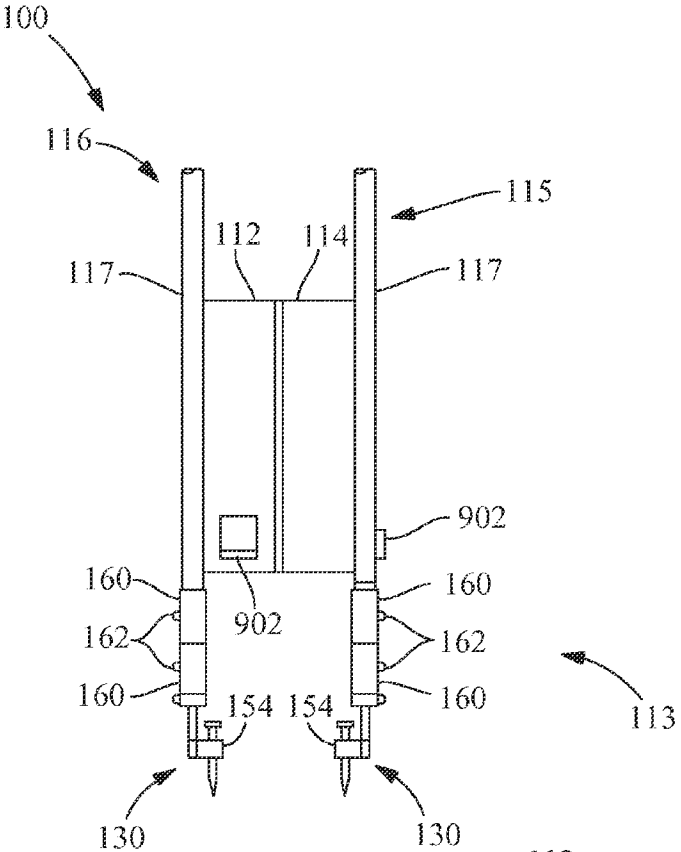
FIG. 9 is a front view of a training aid, according to an embodiment of the disclosure.
Figure 11:
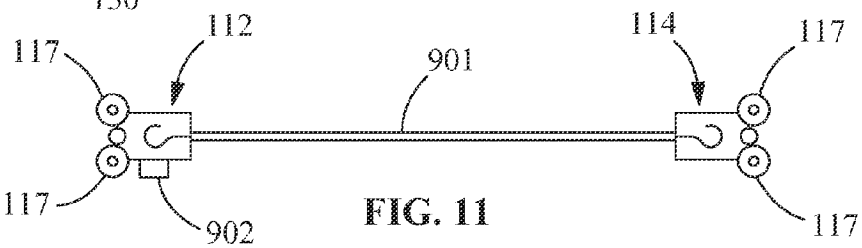
FIG. 11 is a top view of an expanded training aid, according to an embodiment of the disclosure.

Referring to FIGS. 9-11, in one embodiment, the target 111 includes a net 901 connected to the first housing 112 and the second housing 114. For example, in another embodiment, the net 901 includes a retractable net housed within the first housing 112, within the second housing 114, or partially within each of the first housing 112 and the second housing 114. In a further embodiment, the retractable net is attached to a retracting mechanism, such as, but not limited to, a spool or cylinder having a spring attached thereto. The spring applies rotational force to the spool, which applies a retraction force to the retractable net. The retraction force reduces slack in the retractable net, and/or retracts the retractable net within the first housing 112 and/or the second housing 114. For example, in one embodiment, increasing a distance between the first housing 112 and the second housing 114 unwinds the retractable net from the spool to increase an amount of the retractable net that is exposed. The unwinding of the retractable net tightens the spring attached to the spool, which increases the retraction force to decrease slack in the exposed portion of the retractable net. When the distance between the first housing 112 and the second housing 114 is decreased, the retraction force winds the spool to retract the retractable net.

To support the body portion 110 when the net 901 is exposed, either the extendable sections 113 or the fixed sections 115 of the upright posts 117 of the first housing 112 and the second housing 114 are supported by the base portion 130. In one embodiment, the base portion 130 includes two of the stakes 154. In another embodiment, the stake 154 includes at least two stake members to reduce or eliminate rotation of the stake 154 after being secured to a surface (e.g., inserted in the ground). The stakes 154 are secured to the surface at any suitable distance from each other, then the upright posts 117 of the first housing 112 are inserted into one of the stakes 154 and the upright posts 117 of the second housing 114 are inserted into the other stake 154. To insert the upright posts 117 into the stakes 154 the first housing 112 and the second housing 114 are separated, exposing a portion of the net 901 corresponding to the distance between the stakes 154. In an alternate embodiment, the extendable sections 113 of the upright posts 117 are at least partially inserted into the ground to support the body portion 110.

The exposed portion of the net 901 provides a barrier for the user to hit golf balls over or under. For example, the user may practice chipping by hitting golf balls over the net 901, practice punch shots by hitting golf balls under the net 901, play skill games involving the net 901, or a combination thereof. In one embodiment, additional targets 111 are secured to the net 901 to provide additional identification of the exposed portion of the net 901. For example, elongated members may be secured to the retractable net and extend therefrom to form outer barriers that define a horizontal space for the user to practice hitting golf balls at.

In one embodiment, adjusting the distance between the first housing 112 and the second housing 114, for example, by adjusting the distance between the stakes 154, increases or decreases the amount of the net 901 that is exposed. The amount of the net 901 that is exposed includes any suitable distance, such as, but not limited to, up to 8 feet, up to 6 feet, up to 4 feet, or any combination, sub-combination, range, or sub-range thereof. In another embodiment, when the extendable sections 113 of the upright posts 117 are supported by the base portion 130, a height of the net 901 is variable to provide heights such as, but not limited to, between about 1 foot and about 8 feet. In a further embodiment, adjusting the height of the net 901 includes extending or retracting the extendable sections 113 to increase or decrease the height of the first housing 112 and/or the second housing 114. In one embodiment, the body portion 110 includes at least one integral measuring tape 902 for measuring the height of the first housing 112, the second housing 114, and/or the net 901. For example, as shown in FIG. 9, the body portion 110 includes two of the integral measuring tapes 902, one secured to the first housing 112, and one secured to one of the upright posts 117 of the second housing 114. Adjusting the amount of the net 901 that is exposed, and/or the height of the net 901 provides a plurality of different barrier sizes to increase or decrease the difficulty of the shot.

Figure 13:
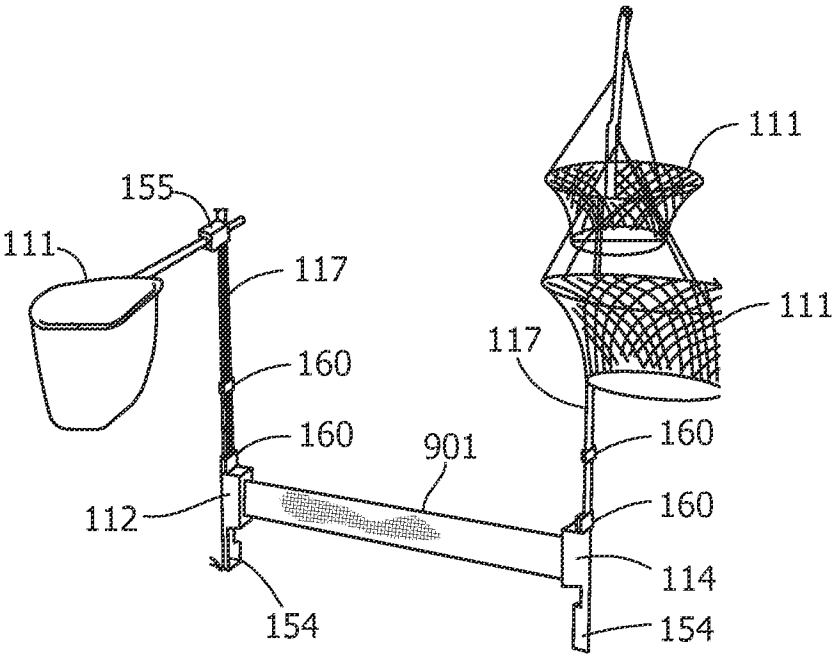
FIG. 13 is a perspective view of the expanded training aid of FIG. 10 including attachments, according to an embodiment of the disclosure.

Alternatively, as shown in FIG. 13, the fixed sections 115 of the upright posts 117 are supported by the base portion 130 to provide a fixed height of the net 901. In one embodiment, at least one of the targets 111 is secured to the upright posts 117 while the net 901 is exposed. For example, as shown in FIG. 13, multiple nets are attached to the stakes 154 positioned on the upright posts 117. In another example, the net 901 is exposed, the rocker arm 140 is supported by the upright posts 117, and at least one of the targets 111 is secured to the upright posts 117 and/or the rocker arm 140.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A golf training aid, comprising:

a body portion, including:

a support comprising a first pair of upright posts attached to a first housing; and a second pair of upright posts attached to a second housing;

a retractable net having a first spool attached to the first housing and a second spool attached to the second housing;

the retractable net operable to vary a distance between the first housing and the second housing;

a rocker arm having a first end and it second end, the first rocker arm end slidably positionable between the first pair upright posts in frictional engagement, and the second rocker arm end slidably positionable between the second pair of upright posts;

a first cap positioned over the first pair of upright posts and a second cap positioned over the second pair of upright posts, the first cap and the second cap maintaining a spacing of the respective first and second pair of upright posts to maintain the rocker arm in an orientation with respect to the body portion;

at least one base portion; and at least one elevated target attached to the rocker arm; wherein the at least one base portion comprises a first base portion and a second base portion; the first pair of upright posts secured to the first base portion, and the second pair of upright posts secured to the second base portion.

2. The golf training aid of claim 1, wherein each of the upright posts comprises an extendable section and a fixed section.

3. The golf training aid of claim 1, wherein the at least one elevated target is selected form the group consisting of an umbrella, a circular opening having a net secured thereto, a soft target, a target with scoring rings, and combinations thereof.

4. The golf training aid of claim 1, wherein the rocker arm is slidable and rotatable between the first pair of upright posts of the first housing and the second pair of upright posts o the second housing.

5. The golf training aid of claim 1, wherein an exposed portion of the retractable net provide; a barrier for hitting golf balls over.

6. The golf training aid of claim 1, wherein a distance between the first base portion and the second base portion corresponds to an amount of the retractable net that is exposed.

7. The golf training aid of claim 1, wherein the base portion is selected from the group consisting of a tripod and stakes.

8. The golf training aid of claim 1, the rocker arm further comprises; a plurality of lateral portions and at least one intersecting portion interconnected by at least one tee fitting; each tee fitting comprising annular openings to receive the lateral portions and the at least one intersecting portion.

9. The golf training aid or claim 8, wherein each of the upright posts comprises an extendable section and a fixed section, and wherein the lateral portions of the rocker arm are positioned between the extendable sections of the upright posts of the first housing and the second housing to support the rocker arm.

10. The golf training aid of claim 8, wherein the at least one tee fitting comprises a first end tee fitting, a middle tee fitting, and a second end tee fitting wherein a first lateral portion extends from the first end tee fitting to the tee fitting, and is positioned between the first pair of upright posts, and a second lateral portion extends from the middle tee fitting to the second end tee fitting positioned between the second pair of upright posts.

11. The golf training aid of claim 8, wherein at least one tee fitting is independently rotatable to provide variable angular positrons for an intersecting opening.

12. The golf training aid of claim 8, wherein the rocker arm comprises two or more sections attached to at least one of the intersecting portions each section including at least one of the lateral portions.

13. The golf training aid of claim 12, wherein the two or more sections comprise a first section and a second section, each of the first section and second section comprising at least one cross fitting, the at least one cross first secured to an opposite end of one of the intersection portions to couple the first section to the second section.

14. The golf training aid of claim 13, wherein the at least one lateral portion has secured thereto at least one of: the at least one tee fitting, an angled fitting, and the at least one target.

15. A golf training method, comprising:

providing a golf training aid including:

a body portion including a first housing having a first pair of uptight posts attached thereto, and a second housing having a second pair of upright posts attached thereto; each of the upright posts having an extendable section and a fixed section;

a rocker arm having a first end and a second end, the first rocker arm end slidably positionable between the first pair of upright posts in frictional engagement, and the second rocker arm end slidably positionable between the second pair of uptight posts;

a first cap positioned over the first pair of upright post and a second cap positioned over the second pair of upright posts the first cap and the second cap maintaining a spacing of the respective first and second pair of upright posts to maintain the rocker arm in an orientation with respect to the body portion;

a base portion: and an elevated target:

supporting the body portion with the base portion:

positioning the rocker arm between the extendable sections of the first pair of upright posts attached to the first housing and the second pair of uptight posts attached to the second housing;

sliding, and rotating the rocker arm positioned between the extendable sections to provide a rocker it orientation:

positioning the first cap over the two uptight posts attached to the first housing and the second cap over the second pair of upright posts attached to the second housing;

attaching the elevated target to the rocker arm; and hitting golf balls at the elevated target.

16. The golf training method of claim 15, further comprising extending the extendable sections to increase a height of the elevated target attached to the rocker arm.

* * * * *